US011810444B2

(12) United States Patent
Rees

(10) Patent No.: US 11,810,444 B2
(45) Date of Patent: Nov. 7, 2023

(54) NOTIFICATION APPARATUS

(71) Applicant: John Christopher Rees, Huntingdon (GB)

(72) Inventor: John Christopher Rees, Huntingdon (GB)

( * ) Notice: Subject to any disclaimer, the term of this patent is extended or adjusted under 35 U.S.C. 154(b) by 0 days.

(21) Appl. No.: 17/633,412

(22) PCT Filed: Aug. 12, 2020

(86) PCT No.: PCT/GB2020/051921
§ 371 (c)(1),
(2) Date: Feb. 7, 2022

(87) PCT Pub. No.: WO2021/028684
PCT Pub. Date: Feb. 18, 2021

(65) Prior Publication Data

US 2022/0309906 A1 Sep. 29, 2022

(30) Foreign Application Priority Data

Aug. 13, 2019 (GB) ..... 1911596
Apr. 8, 2020 (GB) ..... 2005776
(Continued)

(51) Int. Cl.
*G08B 21/24* (2006.01)
*G08B 7/06* (2006.01)
*G08B 25/10* (2006.01)

(52) U.S. Cl.
CPC ..... *G08B 21/245* (2013.01); *G08B 7/06* (2013.01); *G08B 25/10* (2013.01)

(58) Field of Classification Search
CPC ..... G08B 21/245; G08B 7/06; G08B 25/10; E03C 1/057; G16H 40/20; A61B 5/1126; A47K 5/1217; A47K 5/1211
See application file for complete search history.

(56) References Cited

U.S. PATENT DOCUMENTS 7,551,092 B1 * 6/2009 Henry ..... G08B 21/245 340/286.07
2009/0195385 A1 * 8/2009 Huang ..... G16H 40/20 340/572.1
(Continued)

FOREIGN PATENT DOCUMENTS

CA 2937743 A1 8/2015
EM 2985739 A1 2/2016

OTHER PUBLICATIONS

Coffa, Andrew , "EP Serach Report and Written Opinion", dated Nov. 16, 2020, 12 Pages.

*Primary Examiner* — An T Nguyen
(74) *Attorney, Agent, or Firm* — Blanchard Horton PLLC

(57) ABSTRACT

A notification apparatus is provided for monitoring actuation of a hand cleansing device. The apparatus comprises: a hand cleansing device actuation sensor arranged to detect an actuation of a hand cleansing device by an individual, and further arranged to output an actuation signal following said actuation; a controller arranged to receive the actuation signal and output a control signal according to the actuation signal; and a notification member arranged to receive the control signal and output a notification to the individual based on the control signal. The apparatus of the present invention aims to provide a simple and cost-effective solution to ensuring hygiene requirements are upheld while minimising form factor and skill required for installation.

14 Claims, 5 Drawing Sheets

(30) Foreign Application Priority Data

| | | |
|---|---|---|
| Apr. 20, 2020 | (GB) | 2006343 |
| May 13, 2020 | (GB) | 2007424 |
| May 13, 2020 | (GB) | 2007425 |
| Jun. 16, 2020 | (GB) | 2009120 |

(56) References Cited

U.S. PATENT DOCUMENTS

| | | | | |
|---|---|---|---|---|
| 2009/0224907 | A1 | 9/2009 | Sinha et al. | |
| 2010/0134296 | A1* | 6/2010 | Hwang | G08B 21/245 340/573.1 |
| 2015/0216369 | A1* | 8/2015 | Hamilton | G08B 21/245 222/23 |
| 2016/0328948 | A1* | 11/2016 | Ferniany | B05B 15/62 |
| 2020/0217057 | A1* | 7/2020 | Spiro | G06F 3/017 |
| 2020/0279472 | A1* | 9/2020 | Chinikar | E03C 1/055 |

* cited by examiner

NOTIFICATION APPARATUS

FIELD OF THE INVENTION

The present invention relates to a notification apparatus, and particularly to a notification apparatus for informing on usage of a hand cleansing device.

BACKGROUND TO THE INVENTION

Maintaining personal hygiene and hand cleansing in any social setting, such as a hospital, care homes and other care establishments, and a plethora of other environments such as a toilet, is of a high priority.

Rooms within these settings may be fitted with a hand cleansing dispenser or dispensers. In many circumstances it is important for individuals within, or passing through, the room to sanitise their hands before entering and/or leaving a room, particularly when others are present, in order to help prevent the spread of germs and diseases.

The onset of regional, national and worldwide infection crises such as an epidemic or pandemic requires continual respect for personal hygiene. It can, however, be difficult in a busy environment to maintain such required hygiene standards. This is especially important in healthcare or clinical settings, or enclosed populous environments such as an aeroplane or other modes of public transport. It may be the case that healthcare standards require a minimum level of hand cleansing, such as, for example, a minimum time period during or between cleansing one's hands.

Unfortunately, such high hygiene standards as are demanded at a time of high infection risk, such as during a pandemic, are difficult to maintain and many individuals, such as hospital staff, patients and visitors, can enter and leave a room and forget to use a hand cleansing solution provided.

Although hand sanitiser dispensers may be located outside of a room, many people may not use the sanitiser through carelessness or forgetfulness. In many cases it is all too easy for such individuals to go undetected and therefore present as a serious infection risk. Any other individuals coming into contact with such individuals may therefore remain unaware of the risks posed by interacting with such individuals.

It is therefore desirable to provide a solution which overcomes the above described problems, and preferably an elegant solution which requires minimal cost, skill, effort and space in order to maximise uptake, and which is simple and easy to use in order to maximise effectiveness.

SUMMARY OF THE INVENTION

The present application is directed to the detection and monitoring of cleaning and/or sanitising, or cleansing, of hands by an individual. In particular embodiments, the invention is directed to the detection of an actuation of a hand cleansing device by an individual, and the provision of a notification to the individual. The notification may, in some embodiments, provide positive or negative feedback to the individual based on whether the hand cleansing device was actuated. The notification may, in some embodiments, alert the individual and/or other individuals, to the actuation, or lack thereof, of the hand cleansing device. The notification may, in some embodiments, provide instruction on actuation of the hand cleansing device, such as for example providing an indicated minimum period of time for actuating the hand cleansing device and/or cleansing hands. In such embodiments, the notification may be indicative of the minimum period, such as by having a duration equal to the period, or by occurring immediately following the period. The notification may be provided during or immediately after the time period, thereby indicating to the individual the duration (or at least part thereof) of the time period, and/or the end of the time period. In preferable embodiments the notification is intended to indicate a time period for safely and effectively cleaning and/or sanitising, or cleansing hands. The notification may be any suitable visible and/or audible and/or haptic notification to the individual.

In some embodiments, the invention is directed to the detection of an exit event of an individual in the absence of an acknowledgement that the individual has cleansed their hands. Upon detection of said combination of an exit event and absence of acknowledgement of hand cleansing, the present invention may be arranged output an alert to the user. The principal aim of the alert may be to direct the user to cleanse their hands, although an additional potential aim of the alert may be to inform others that the individual has not cleansed their hands.

In accordance with a first aspect of the present invention, there is provided a notification apparatus for providing a notification during or following actuation of a hand cleansing device, the apparatus comprising: a hand cleansing device actuation sensor arranged to detect an actuation of a hand cleansing device by an individual, and further arranged to output an actuation signal following said actuation; a controller arranged to receive the actuation signal and output a control signal according to the actuation signal; and a notification member arranged to receive the control signal and output a notification to the individual based on the control signal. The controller may be any suitable controller, and may, for example, comprise a processor.

In preferable embodiments, the notification may comprise a duration, the duration being a predetermined notification period. In some such embodiments, the notification may be provided at the start of the predetermined notification period, during the predetermined notification period, and/or immediately following the predetermined notification period. In accordance with such embodiments, the individual may continue to actuate the hand cleansing device throughout the notification period, which may indicate a safe and effective period for cleansing hands as described herein.

In some preferable embodiments, the apparatus may further comprise a timer in communication with the controller and arranged to provide the predetermined notification period, the controller arranged to output the control signal according to the predetermined notification period. The notification member may be arranged to output the notification during at least a portion of the predetermined notification period and/or immediately following the predetermined notification period, based on the control signal.

Embodiments will be appreciated wherein the notification is any suitable notification. The notification may be an intermittent notification which may be output by the notification member at intervals during the time period, or may be a single and/or sustained notification output by the notification member during or subsequently to the time period. It will be understood that a notification output immediately following the notification period may be intended to signal cessation of the notification period.

The controller may, in some embodiments, be arranged to determine, from the actuation signal, an actuation period. The actuation period may, in some embodiments, be used to identify a period during which the individual cleanses their hands. Such an actuation period may be usable by some embodiments of the invention to determine whether the individual has cleansed their hands for a sufficient duration, which may be so as to achieve safe and effective hand cleansing. In some embodiments, the controller is arranged to compare the actuation period to the predetermined notification period; and wherein following a determination by the controller that the actuation period subceeds the predetermined notification period, the controller is arranged to output an alert signal.

In some embodiments, the apparatus further comprises an alerting array, the alerting array being arranged to receive the alert signal and output a visible and/or audible alert. Such an alert may be any suitable audible and/or visible alert which may be used to inform the individual, and/or other individuals that the individual has not cleansed their hands for the full predetermined notification period.

The notification may comprise any suitable such notification, and may for example comprise one selected from the group: a countdown timer; an audio sequence; a video sequence; a light sequence; a haptic sequence; a vibratory sequence; a movement sequence.

The predetermined notification period comprises a duration, the duration preferably being predetermined according to a safe minimum hand cleansing period. The safe minimum hand cleansing period is further described herein and may, for example be selected from between 10 seconds and 30 seconds.

In some embodiments, the apparatus may further comprise a memory. The memory may in some embodiments be arranged to store, for example, a count of the number of the times the actuation sensor senses an actuation of the hand cleansing device. The memory may, in some embodiments, comprise stored thereon one or more files comprising notifications to be played by the notification member. In such embodiments, the files may comprise a video or audio sequence, or a sequence of instructions such as to operate an LED display panel in a manner in accordance with the instructions. The memory may, in some embodiments, be part of a record and play module, which may further comprise a microphone, and which may be arranged receive and store an audible (such as verbal) message to be played by the notification member (which may, for example, comprise a speaker).

The actuation sensor may comprise any suitable sensor arranged to detect actuation of the hand cleansing device, and may, for example, comprise a motion sensor; an infrared sensor; a proximity sensor; a pressure sensor; an image capture device; a trembler circuit. Preferable embodiments comprise an actuation sensor arranged to be retrofit to an existing hand cleansing device, such as having a trembler circuit and being arranged to detect minimal movement of the hand cleansing device or a component thereof. In such embodiments, the apparatus may comprise a small form factor and permit maximal ease of installation, which may be by retrofit to an existing hand cleansing device. Such embodiments therefore promote maximum uptake and therefore optimal infection risk reduction.

In accordance with some embodiments, the notification apparatus further comprises: a detector array comprising one or more detectors, the detector array arranged to detect an exit action of the individual, and output an exit signal following said detection; wherein the controller is further arranged to: receive the exit signal; identify the exit signal and an absence of the actuation signal; and output an alert signal following said identification; the notification member being arranged to receive the alert signal and output an alert to the individual.

The term "exit action" will be understood as any action by which the individual "exits" the area proximate the hand cleansing device. Such an exit action may, in some examples, include the exiting of a room in which the hand cleansing device is located. An exit action in some less-enclosed environments, such as at a convention stand for instance, may be the moving of the individual away from the hand cleansing device, and potentially into a crowded convention hall, a lecture hall or other speaking venue. Other milder examples may, for example, interpret an exit action as the entering of a house or apartment building, and therefore "moving away" from a hand cleansing device positioned outside the front door of said house or building. In principle therefore, the "exit action" is intended to convey any action by which the individual may advance past a hygiene check, for example washing their hands following a toilet visit. The exit action may be detected by one or more detectors of the detector array, which may themselves be collocated. Collocation of the detectors may be preferable for minimising complexity and form factor of the invention.

The present invention aims to minimise germ transmission within any environment, and particularly environments which are particularly sensitive to said germ transmission. Particularly sensitive environments might be any enclosed environment which experiences a large amount of diverse foot traffic. Such environments might, for example, include healthcare venues such as hospitals, general practices and nursing homes; hospitality venues such as hotels, cafes, restaurants, convention centres, and exhibition centres; employment venues such as offices or factories; and public transport such as aeroplanes, trains, buses, coaches, ferries and cruise ships. Other suitable environments will be apparent, and will include any environment where germ transmission poses a risk of increasing infection rate. Milder examples may, for example, include a house or apartment block.

By alerting an individual to the need to cleanse their hands, or potentially highlighting to others within the environment when the individual has not cleansed their hands, embodiments of the present invention preferably provide a crucial reduction in infection risk. The present elegant solution preferably provides a simple and cost-effective means of employing hygiene notification and monitoring in any environment, which can be installed with minimal impact to existing structures within the environment, and with minimal to no requirement for skilled installation or maintenance. The present solution therefore favours maximum uptake and therefore maximum effectiveness in reducing infection risk.

In some embodiments of the present invention, the detector array may be further arranged to detect an entrance action of the individual, the entrance action detected prior to said exit action, and output an entrance signal following said detection.

The term "entrance action" will be understood as any action which precedes the "exit action" described earlier, and may, for example include entering an area proximate a hand cleansing device, such as a toilet area for example. The detected "entrance action" may be used by the invention in order to inform any downstream detections of the individual. For example, the hand cleansing device actuation sensor may be arranged to receive the entrance signal, and wherein the hand cleansing device actuation sensor may be then arranged to detect said actuation of the hand cleansing device following said receipt. In such embodiments, the controller is preferably further arranged to receive the entrance signal, and further arranged to identify the entrance signal and the exit signal, both in absence of the actuation signal, and further arranged to output the alert signal following said identification.

Thereby, the entrance action may cause activation of the downstream components of the invention, such as the hand cleansing device actuation sensor, the notification member, or the components of the detector array arranged to detect the exit action. In some embodiments, activation of said downstream components may be useful in order to conserve power usage pre-activation. The activation of said components may occur for a predetermined activation period, during which the activated components remain activated, before returning to a state of reduced power consumption. Such embodiments may be particularly desirable in embodiments wherein an on-board power supply is used to power said components, such as by battery power. Conserving energy by detecting an entrance action may therefore minimise consumable costs and labour costs associated with purchasing, storing and replacing batteries, which may in-turn reduce the complexities of ongoing maintenance of such embodiments. Continued battery replacement can additionally cause a depreciation or wear and tear of components over time, eventually leading to swifter replacement of the associated component. A reduced cost and complexity associated with ongoing maintenance of the presence invention preferably provides an improvement of uptake of the invention.

The entrance action may be detected by the same detector of the detector array as that arranged to detect the exit action, or may in some embodiments be detected by a difference detector of the detector array. In preferable embodiments, the entrance action is detected by the same detector of the detector array as that used for detection of the exit action. Such embodiments may preferably reduce complexity and form factor of the invention, which may minimise effort and skill required for instalment, along with impact of instalment, thereby maximising efficiency and uptake.

In some embodiments, the detector array may comprise the notification member as a component thereof. It will therefore be apparent that the present invention is not intended to preclude combination of components for simplification of design and reduced form factor. Such improved simplification and reduced form factor preferably improves compatibility of the present invention with a variety of environments and therefore maximises the number of suitable applications and therefore uptake.

The detector array preferably comprises one or more sensors arranged to detect the exit action, the one or more sensors being selected from the group: an infrared sensor; door lock actuation sensor; a door actuation sensor; a door handle actuation sensor; a pressure sensor; a proximity sensor; a motion sensor; an automatic door actuation sensor; an image capture device; a trembler device. It will be appreciated that in any embodiments wherein the detector array is also arranged to detect an entrance action, the detector array may comprise any equivalent or different sensors suitable for detecting said entrance action, and may comprise one or more sensors detected from the aforementioned group. The one or more sensors preferably comprise passive sensors and thereby reduce power consumption during operation, preserving any on-board power supply, such as a battery supply, in respective embodiments. The sensor is intended to detect any suitable exit or entrance action, and therefore may include any action associated with entering or exiting a space proximate a hand cleansing device. The action may, for example, comprise actuating a door to approach or leave the space or approaching an area of the space associated with "entering" or "leaving" the hand cleansing area. Actuation of a door may occur by mechanical means or by any other means, such as by way of activating an automatic door, which may make use of pressure sensors, infrared, or an image capture device. Suitable image capture devices will be appreciated but may include closed-circuit television (CCTV).

The controller may, in some embodiments, be arranged to determine a time period between the actuation signal and the exit signal; wherein the controller is further arranged to detect that the time period is shorter than a predetermined time threshold, and output the alert signal following said detection. The time period may be freely adjustable by a user and may, for example, be implemented using an adjustable timer.

The time period between the actuation signal and the exit signal is preferably a measure of (and/or includes) the time taken by the individual to cleanse their hands using the hand cleansing device. It may be the case that, following for example healthcare policy guidance, a predefined time period for cleansing of one's hands is advised. The controller of the present invention may therefore impose a minimum time constraint on the period spent by the individual using the hand cleansing device to cleanse their hands. Should the time period between the actuation signal and the exit signal be shorter than a predetermined time threshold, determined according to said advice for example, such embodiments of the present invention may cause an alert to the individual and/or an alert to other individuals within or proximate the environment, that the individual has not satisfied the required hand cleansing time constraints. A safe predetermined time threshold may, for example, be selected from between 10 seconds and 30 seconds. In preferable embodiments, the predetermined time threshold may be 20 seconds. Following output of the alert signal by the controller, the alert signal is preferably received by the notification member (which may in some embodiments comprise an alerting array) which is subsequently arranged to output a corresponding alert to the individual and/or other individuals proximate or within the environment.

The apparatus may comprise a separate notification member arranged to provide the alert, to the notification member arranged to provide the notification. It will be understood that embodiments will exist wherein the notification may be equivalent to the alert. In some embodiments, the notification member arranged to output the alert is preferably remote to the hand cleansing device actuation sensor. In most applications the alerting notification member will be positioned remote to the hand cleansing device and therefore not form part of the hand cleansing device or the hand cleansing device actuation sensor. Embodiments will of course be appreciated wherein the alerting notification member (which may for example be an alerting array comprising one or more alerting members) is located proximal to or as part of the hand cleansing device actuation sensor.

The notification member preferably comprises an on-board power supply, and is preferably battery-powered. Therefore, in such preferable embodiments, no wiring is required for providing power to the notification member. As such, the present invention preferably minimises the need for trained personnel to install the invention, and therefore aims to deskill the task of installation, thereby reducing impact and cost and maximising uptake. Embodiments will be appreciated wherein any suitable power supply is used, and may comprise any direct or adapted/rectified link to mains power.

In some preferable embodiments, the notification member, such as the alerting notification member, is positioned on or proximate an entrance and/or exit to a space, and is preferably positioned on or proximate an entrance and/or exit door. The notification member is preferably visible or audible to the individual and is therefore preferably positioned such that the visibility and/or audibility of the alert of the notification member is maximised. The effect of the alert is intended to be the highlighting of the need for the individual to cleanse their hands. Therefore, the notification member is preferably positioned downstream of the hand cleansing device and proximate an entrance or exit to a space requiring hand cleansing prior to an exit action.

The alert is preferably a visible and/or audible and/or haptic alert. In preferable embodiments, the one or more alerting members may comprise a display member arranged to display a light or video sequence as at least part of the alert. Such a display member may be any suitable display, and may include an LED panel or a LCD display screen. The display member is preferably arranged to output a plurality of different alerts depending upon a given output of the invention. For example, embodiments of the invention will be appreciated wherein the alert may comprise both a positive alert, indicating that the individual has made safe and effective use of the hand cleansing device (following receipt of an actuation signal from the hand cleansing device actuation sensor by the controller), and a negative alert, indicating that the individual has not made safe and effective use of the hand cleansing device (following detection of an exit action in absence of an actuation signal from the hand cleansing device actuation sensor).

The one or more alerting members may comprise an audio member arranged to emit an audible sound or message as at least part of the alert. An example embodiment may comprise a door bell, and may in some such embodiments provide a positive alert to other individuals by means of a door bell, and a negative alert by means of an audible and/or visible and/or haptic alert to instruct the individual to cleanse their hands. The present invention may, in such embodiments, provide an access barrier whereby safe and effective actuation of a hand cleansing device is required for entry to a space or building. Further examples may permit the recording of a verbal alert by an individual to be used as an audible alert by the notification member, which may therefore comprise a memory and recording member arranged to record and store said verbal alert. Other suitable applications benefiting from an audible alert of the present invention will be appreciated.

The detector array is preferably in wireless communication with the hand cleansing device actuation sensor. The hand cleansing device actuation sensor is further preferably in wireless communication with the notification member. The present invention therefore preferably minimises the requirement for rewiring a space in order to install the present invention, reducing the required skill and the level of impact required from such an installation. The wireless communication may be any suitable form of wireless transmission of the entrance signal, the exit signal, the actuation signal and/or the alert signal, and may for example comprise one selected from the range: Bluetooth; Wi-Fi; mobile communication technology; radio frequency; LoRaWAN.

The one or more alerting members preferably comprise a fixing means arranged to affix the one or more alerting members to a surface. The affixing means preferably comprises at least one selected from the group: adhesive; screw; magnet. In accordance with preferable embodiments, the affixing means preferably confers a minimal impact on the environment in which the present invention is installed, and preferably comprises an adhesive or a magnet. Embodiments will, however, be appreciated wherein the affixing means is any suitable affixing means for affixing the invention to a surface within the environment.

The notification member preferably comprises an alerting array preferably having a first alerting member positioned on an interior surface of a room, and a second alerting member positioned on an exterior surface of said room. In such embodiments, the second alerting member may be intended to alert other individuals to ineffective- or non-usage of a hand cleansing device by the individual. Such an external alerting member preferably provides added impetus to the individual to cleanse their hands in a safe and effective manner using the hand cleansing device, and may act to deter ineffective- or non-usage in the future.

The first alerting member and the second alerting member are preferably in electronic and/or wirelessly communication, with each other. In embodiments wherein the first alerting member and the second alerting member are in wired communication with each other, the wired communication preferably makes use of a simple connection, such as a snap-fit or push-fit connection, thereby improving ease of installation and deskilling the installation operation.

The controller may, in some embodiments, output the exit signal or the entrance signal to a memory in order to store or log the footfall to a particular area. Such footfall count information may be useful to an establishment for the purpose of determining how many individuals are using the hand cleansing device safely and effectively, which may be useful to inform any required training to be provided. The exit signal and/or exit signal may be used by the controller to output an alert signal to the notification member which may indicate that a particular area, such as a toilet for example, is "in operation" or "vacant".

The present invention may further comprise a series of tags (such as RFID tags for example) or other suitable electronic badges comprising identification information, and may be detected by the detector array in order to inform the controller of the identification of the individual. Such information may be useful for logging safe and effective use of the hand cleansing device, and may be useful for informing a hand cleansing training program.

In accordance with a second aspect of the present invention, there is provided a hand cleansing device for alerting an individual to cleanse their hands, the hand cleansing device comprising: a dispenser unit arranged to dispense a hand cleansing fluid; and a notification apparatus comprising: an actuation sensor arranged to detect an actuation of the dispenser unit by the individual, and further arranged to output an actuation signal following said actuation; a controller arranged to receive the actuation signal and output a control signal according to the actuation signal; and a notification member arranged to receive the control signal and output a notification to the individual based on the control signal.

In the context of the present invention, the term "cleansing" will be understood by the skilled addressee to mean either cleaning or sanitation alone or in combination. For example "cleansing" may include the physical removal of germs and dirt using, for example, a detergent, and/or neutralisation of germs using, for example, a sanitising fluid. While the present invention is primarily directed to monitoring actuation of "hand cleansing" devices, the invention will be understood to be equally applicable to any suitable cleansing or sanitising apparatus or equipment, and the present disclosure is therefore not intended to be limited to monitoring of actuation of hand cleansing devices.

The notification apparatus as part of the second aspect, may in preferable embodiments be a notification apparatus in accordance with the first aspect. The notification apparatus may be in wired and/or wireless communication with the dispenser unit, and examples of suitable modes of wireless communication are described herein.

The dispenser unit may comprise a manual fluid dispenser or an automatic fluid dispenser. In embodiments of the present notification apparatus or hand cleansing device having an automatic fluid dispenser, the fluid dispenser may be contact-free and comprise a sensor arranged to sense proximity of the individual's hands to the dispenser ahead of applying a dispenser fluid therefrom.

The hand cleansing fluid may comprise any suitable hand cleansing fluid, and preferably comprises one or more selected from the group: a sanitising liquid; a soap; a gel; water. It will therefore be appreciated that any suitable hand cleansing device dispenser, or combination of hand cleansing device dispensers, are intended for use with the present invention, and may combine a soap dispenser and a water dispenser.

The hand cleansing device preferably comprises an on-board power supply and is preferably battery-powered. For the reasons discussed herein, the present invention preferably makes use of components requiring minimal installation skill, effort and cost.

The dispenser unit preferably further comprises a notification member arranged to output a visible and/or audible and/or haptic notification. The notification may comprise one selected from the group: a countdown timer; an audio sequence; a video sequence; a light sequence; a haptic sequence; a vibratory sequence; a movement sequence. The notification member may be a part of a notification apparatus in accordance with the first aspect, and the hand cleansing device may therefore in some embodiments be, or comprise, a hand cleansing device in accordance with the second aspect. The dispenser unit itself may provide an output to the individual during operation, and may include a positive alert or an indication of a time period for safe and effective use of the hand cleansing device. The notification may therefore comprise a duration, the duration being predetermined according to a safe minimum hand cleansing period. The safe minimum hand cleansing period may be any suitable period and may be driven by healthcare policy or advice, and is preferably selected from between 10 seconds and 30 seconds, and most preferably 20 seconds.

The notification may in some embodiments be personalised to a user or specific to a particular application. Such personalised notifications may be, some embodiments, linked to a personalised electronic badge or tag (such as an RFID tag) of the individual which is detected by the present invention. For example the tag or badge may comprise, stored thereon an identifier of a notification, such as a personal song or message to be played during operation of the hand cleansing device. The notification may comprise a time duration which may be linked to a safe and effective period for cleansing one's hands as described herein. Embodiments will be appreciated wherein said notification may be triggered following an entrance signal received by the hand cleansing device or hand cleansing device actuation sensor. Additional embodiments will be appreciated wherein the dispenser unit or hand cleansing device comprises a volume adjustment member arranged to adjust a volume of the notification. In some embodiments the dispenser unit may comprise a selection member arranged to receive input from a user to select a notification to be provided, such as a song or video. In some specific settings, such as a hospital, the notification may comprise health and safety message regarding the risks of not cleansing one's hands and disease transmission.

The dispenser unit preferably comprises one or more hand cleansing fluid cartridges. The cartridges preferably provide an ease of changing the dispenser fluid once empty, requiring minimal manual interaction with the dispenser and therefore minimal opportunity for infection transmission. The cartridges preferably comprise a compatibility feature, such as an electronic component (for example a diode) required for the functioning of the hand cleansing device, thereby defining a compatibility requirement for only authorised cartridges to be installed. The present invention, in such embodiments, thereby maintains compliance with cleanliness requirements without permitting alternative fluid replacement means, the installation of which may compromise the hygiene of users of the hand cleansing device.

The dispenser unit comprises, in some embodiments, a hand cleansing fluid level sensor arranged to detect an amount of hand cleansing fluid located in the dispenser unit below a predetermined level threshold; wherein the fluid level sensor is arranged to output a fluid level alert signal. The dispenser unit therefore preferably maximises the utility of the present invention by maintaining alertness of maintenance staff to the fluid fill status of the dispenser. The notification member may therefore be arranged to receive the level alert signal and output a level alert to the individual. The invention may comprise a battery level sensor arranged to detect a battery level of any component of the present invention; wherein the battery level sensor is arranged to output a battery level alert signal. In the same way as the fluid level sensor, the battery level sensor preferably maintains alertness of maintenance personnel to the availability of power to the components of the invention, such as the detector(s) of the detector array and the alerting member(s) of the alerting array and the hand cleansing device actuation sensor.

The actuation sensor may be further arranged to detect an actuation of a water dispenser by the user. The combined use of, for example, soap and water may therefore be a requirement for safe and effective use of the hand cleansing device, and absence of this may result in an alert sent to the notification member.

The dispenser unit, in some embodiments, may comprise the detector array and/or the notification member. Such a combination of features may be preferable for minimising form factor and complexity of the present invention, and may be suitable for specific applications requiring minimal occupancy of space within the environment.

The dispenser may, in some embodiments, comprise a manual input device, such as a button (which may be positioned, for example, on a cable suspended from the dispenser or hand cleansing device) and a motor arranged to adjust a height of the dispenser. In such embodiments, the manual input device or button may actuate the motor in order to increase or decrease the height of the dispenser. Such a feature may maximise the accessibility of the present invention, particularly for wheel-chair users. Embodiments will be apparent wherein the manual input device is in wireless communication with the motor and/or dispenser and/or hand cleansing device, and may be arranged to operate the dispenser remotely.

Any feature described herein as being suitable for incorporation into one or more aspects or embodiments of the present invention will be understood as intended to be generalizable across any and all aspects and embodiments of the present invention. Additionally, and for the avoidance of doubt, any indication of a preference level e.g. "preferably", "more preferably", "most preferably" is not intended to define discrete categories of preference, or intended to preclude combinations of features across varying levels of preference.

DETAILED DESCRIPTION

Specific embodiments will now be described by way of example only, and with reference to the accompanying drawings, in which.

Figure 1:
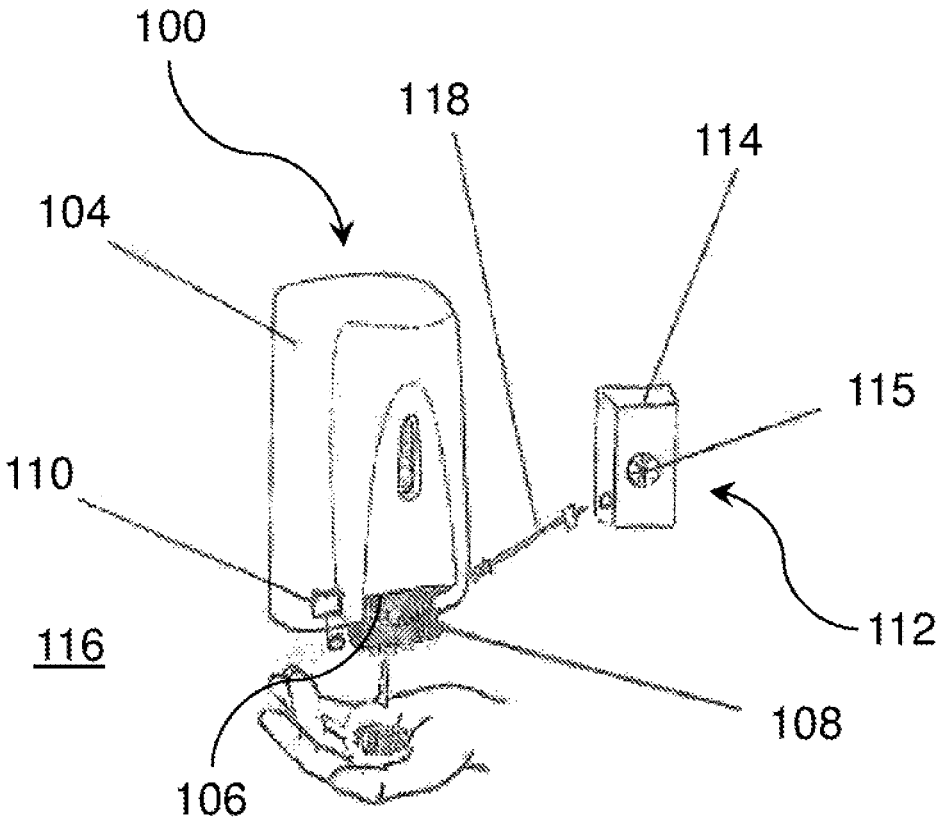
FIG. 1 shows a close-up perspective view of an example hand cleansing device in accordance with the second aspect is shown comprising a notification apparatus in accordance with the first aspect of the present invention.

Referring to FIG. 1, a close-up perspective view of an example hand cleansing device 100 in accordance with the second aspect of the present invention is shown, comprising a notification apparatus 102 in accordance with the first aspect.

The hand cleansing device 100 comprises a substantially cuboidal housing 104 having its long axis oriented vertically. The housing 104 of the embodiment 100 shown accommodates a hand cleansing fluid dispenser unit (not shown) housed therewithin. The dispenser unit terminates at a fluid dispensing nozzle (not shown) protruding from an opening 106 positioned in a lower face of the housing 104. The hand cleansing device 100 comprises a dispenser actuating member 108 extending from a lower portion of the housing 104, the actuating member 108 taking the form of a planar rectangular paddle 108. The paddle 108 is connected to the dispenser unit by way of a dispensing mechanism (not shown), wherein manual interaction with the paddle 108 by an individual actuates the dispensing mechanism resulting in an ejection of hand cleansing fluid from the nozzle of the dispenser unit as shown in FIG. 1.

The hand cleansing device 100 further comprises an actuation sensor 110 positioned adjacent the paddle 108 and oriented to detect said interaction with the paddle 108 by the individual.

The hand cleansing device 100 further comprises a notification member 112 positioned proximate the housing 104, and located on a surface of a wall 116 which also supports the hand cleansing device 100 thereon. The notification member 112 comprises a housing 114 supporting a record and play module including a microphone, a memory, a processor, a timer and a speaker 115, the microphone arranged to receive an audible (for example verbal) message, the memory arranged to store the message, and the speaker 115 arranged to output the message to the individual. The record and play module is in wired communication with the hand cleansing device actuation sensor 110 by a wire 118.

The environment defined in FIG. 1 is a hand cleansing area of a restroom. In use an individual passing by the hand cleansing device 100 actuates the paddle 108 to release a hand cleansing fluid from the dispenser unit. In the embodiment shown the dispenser unit comprise a cartridge for dispensing soap. Any suitable hand cleansing fluid (cleaning and/or sanitising) will be appreciated by the skilled reader. Upon actuation of the paddle 108, the actuation sensor 110 detects the actuation and provides the actuation signal to the processor of the notification member 112. The processor receives the actuation signal, accesses a pre-recorded verbal message saved on the memory, a predetermined notification period according to the timer, and provides a control signal to the speaker 115, the control signal comprising the pre-recorded message. Upon receipt of the control signal the speaker 115 emits the pre-recorded message as an audible notification to the individual, at intervals for the duration of the predetermined notification period. In the embodiment shown, the predetermined notification period is 20 seconds, but embodiments will be appreciated wherein the notification period is any suitable period for maximising cleansing of hands, and may be driven by healthcare policy or advice.

Embodiments will be appreciated wherein the processor outputs the control signal to the notification member only immediately following the predetermined notification period of the timer, and may for example confirm to the individual that the notification period has ceased. Embodiments will also be appreciated wherein the notification member is arranged to provide the notification to a different individual, confirming to the different individual that the first individual has cleansed their hands for the predetermined period. In such embodiments, the notification member may, for example, comprise a door bell, arranged to indicate to an individual within a room or building that a separate individual entering the building has effectively cleansed their hands for the predetermined period. Embodiments will be appreciated comprising the notification member described in relation to FIG. 1, in addition to a further notification member such as the doorbell described.

Figure 2:
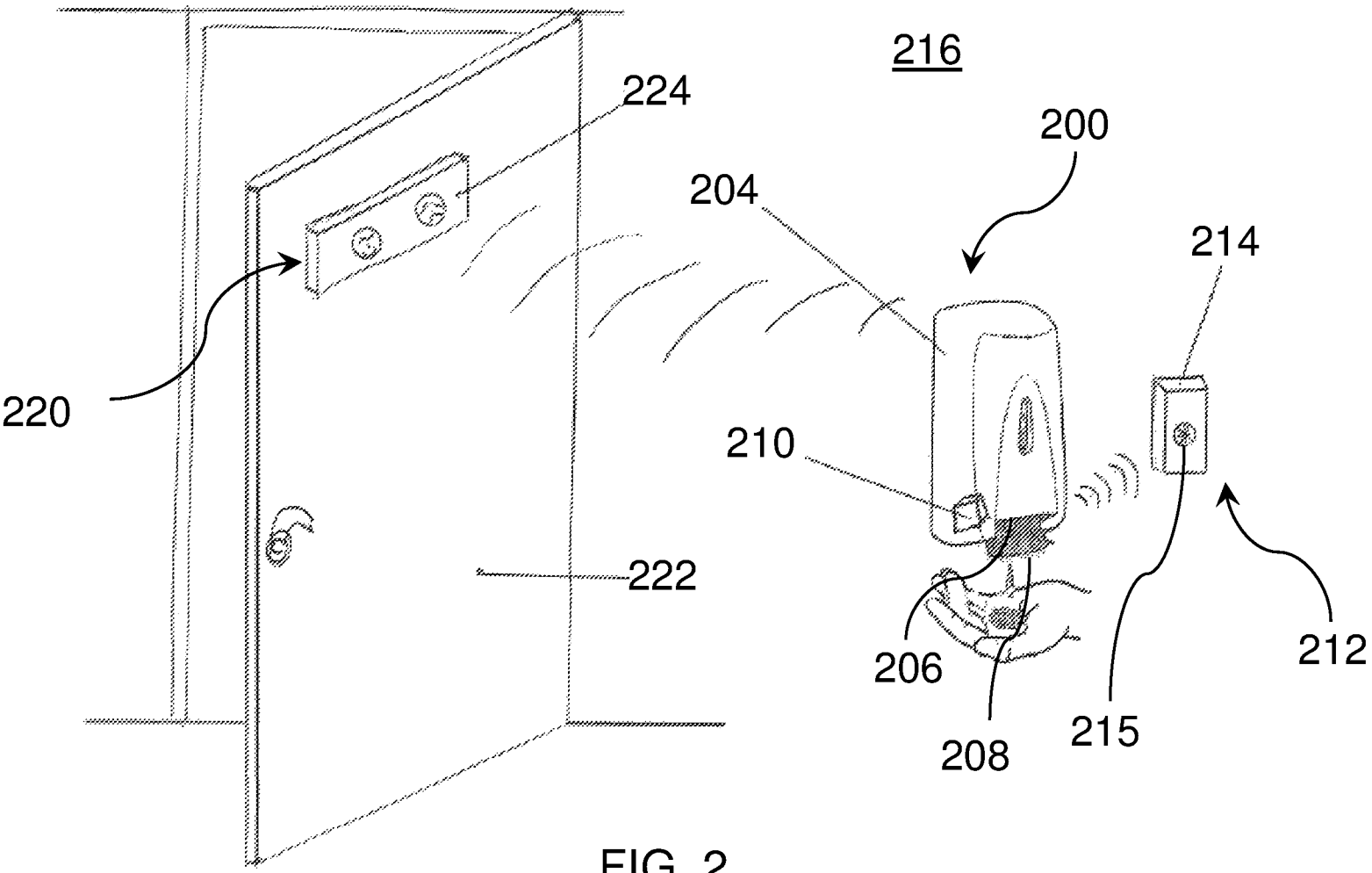
FIG. 2 shows a full perspective view of an example hand cleansing device in accordance with the second aspect comprising a notification apparatus in accordance with the first aspect.

Referring to FIG. 2, a full perspective view of an example hand cleansing device 200 in accordance with the second aspect is shown comprising a notification apparatus in accordance with the first aspect. The embodiment 200 shown comprises a hand cleansing device substantially as described for FIG. 1, having a substantially cuboidal housing 204 having its long axis oriented vertically, accommodating a hand cleansing fluid dispenser unit (not shown) housed therewithin. The dispenser unit terminates at a fluid dispensing nozzle (not shown) protruding from an opening 206 positioned in a lower face of the housing 204. The hand cleansing device 200 comprises a dispenser actuating member 208 extending from a lower portion of the housing 204, the actuating member 208 taking the form of a planar rectangular paddle 208. The paddle 208 is connected to the dispenser unit by way of a dispensing mechanism (not shown), wherein manual interaction with the paddle 208 by an individual actuates the dispensing mechanism resulting in an ejection of hand cleansing fluid from the nozzle of the dispenser unit as shown in FIG. 2.

The hand cleansing device 200 further comprises an actuation sensor 210 positioned adjacent the paddle 208 and oriented to detect said interaction with the paddle 208 by the individual.

The notification apparatus 200 further comprises a detector 212 positioned proximate the housing 204, and located on a surface of a wall 216 which also supports the hand cleansing device 200 thereon. The detector 212 comprises a housing 214 supporting a movement sensor 215 positioned to detect movement occurring away from the sensor 215. The detector 212 is in wireless communication with the hand cleansing device actuation sensor 210.

The embodiment 200 shown further comprises an alerting member 220 positioned on a door 222 adjacent the wall 218, the door 222 providing an exit to an environment defined by the wall 218. Positioned on a surface of the door 222 facing said environment, on an upper portion thereof, the alerting member 220 comprises a rectangular housing 224 oriented with its long axis perpendicular to the long axis of the door 222, the housing accommodating a PCB 226 having a plurality of LEDs 227, 229 thereon. At opposing ends of the housing, and positioned on an outer principal face thereof are a pair of apertures 228 through which the LEDs 227, 229 are visible, the apertures 228 each occluded by a translucent coloured plastic cover 230, 232 arranged to permit light from the LEDs 227, 229 to be visible therethrough. The PCB 226 further comprises second motion sensor 234 and a processor 236 in wireless communication with the hand cleansing device actuation sensor 210 and the detector 212.

In use, an individual passing by the detector 212 is detected by the movement sensor 214 of the detector 212, and the detector 212 outputs a first exit signal (or "an entrance signal") to the processor 236. When the individual acts to leave the environment by exiting through the door 222, the second motion sensor 234 of the alerting member 220 detects said movement and outputs a second exit signal (or simply "an exit signal") to the processor 236. The processor 236 then emits a controlling "alert signal" which actuates the LEDs 227, 229 according to whether an actuation signal was received from the hand cleansing device actuation sensor 210. If no actuation signal was received in between receipts of the first exit signal and the second exit signal, indicating that the hand cleansing device 202 was not used by the individual, LEDs 227 are actuated by the processor 236 corresponding to a negative alert, which in the embodiment shown is depicted by a red translucent plastic cover 230 showing a frowning face. If an actuation signal was received by the processor 236 in between the first exit signal and the second exit signal, indicating that the hand cleansing device 202 was indeed used by the individual, LEDs 229 are actuated by the processor 236 corresponding to a positive alert, which in the embodiment shown is depicted by a green translucent plastic cover 232 showing a smiling face.

Thereby the embodiment 200 of FIG. 2 provides either a positive or a negative alert to the individual based on the use, or lack thereof, of the hand cleansing device 200. Embodiments will be appreciated wherein the processor is in further communication with a timer arranged to indicate and or calculate a time duration between the actuation signal and the second exit signal, wherein the time duration is then compared by the processor with a predetermined time threshold in order to inform a positive or negative alert provided to the individual. The threshold may, for example, indicate a safe and effective period for cleansing one's hands. In some such embodiments, if the time duration is shorter than the threshold, the processor may actuate the LEDs using a negative alert signal, providing a negative alert to the user as described earlier in relation to FIG. 2.

Embodiments will also be appreciated wherein the PCB does not comprise a motion sensor, and instead comprises any suitable detector means for detecting the second exit signal, such as a sensor linked to the door handle, the door lock, the door orientation, or the door movement.

The environment of the embodiment 200 of FIG. 2 shows a toilet cubicle wherein only a single individual passing in and out of the door 222 is expected at one time. In more open environments permitting a plurality of individuals passing through the environment between the first exit signal detection and the second exit signal detection, the processor 236 may be arranged to count instances of a first exit signal (or "entrance signal"), storing said count on a memory module 239, and compare this with a count of instances of a second exit signal (or "exit signal") in order to inform the provision of an alert signal accordingly. In such embodiments, the detectors and the actuation sensor may comprise a means of distinguishing the different individuals, such as by way of image recognition or personal tag (such as an RFID tag) recognition.

Figure 3:
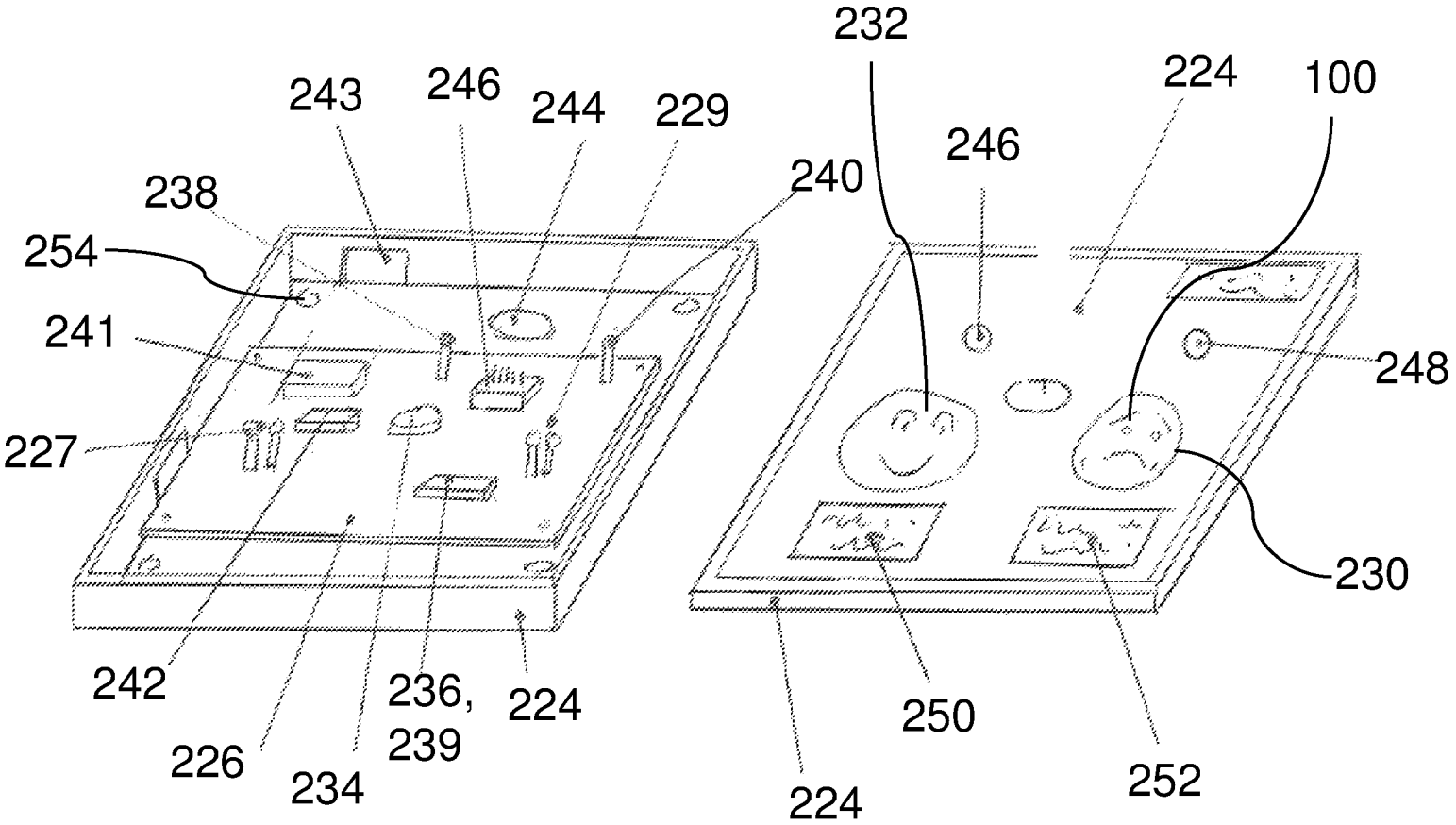
FIG. 3 shows an example dissected view of the alerting member shown in FIG. 2.

Referring to FIG. 3, a dissected view of the alerting member 220 is shown comprising the housing 224 accommodating the PCB 226 supporting the LEDs 227, 229, the motion sensor 234 and the processor 236. The PCB 226 also supports a low-battery alert indicator 238 and a low-fluid alert indicator 240, each corresponding to a respective sensor located on the hand cleansing device 202 and the detector 212 arranged to sense a fluid level of the cleansing fluid dispenser unit and a battery level of the hand cleansing device 202 and the detector 212. Each respective said level sensor is arranged to output a level signal to be received by the processor 236 and compared to a predetermined level threshold stored on the memory module 239. In instances wherein the level signal is below the level threshold, the processor 236 is arranged to output a level alert signal to the corresponding alert indicator 238, 240 to provide an alert to an individual, by way of a corresponding aperture 246, 248 in the principal face of the housing 224. The alerting member 220 is also powered by batteries 241 located on-board the alerting member 220 and inserted/removed by way of a battery port 243 of the alerting member 220. Embodiments will be appreciated wherein the level sensors and the corresponding level indicators are positioned on the hand cleansing device and/or detectors themselves.

The PCB 226 further supports a wireless transceiver 242 arranged to receive each of the signals received from the hand cleansing device 202 and/or the detector.

Not shown, but comprised within the embodiment 200 of FIG. 2 to FIG. 3 is a second alerting member similar to the alerting member 220 shown in FIG. 2 and FIG. 3, but positioned on a surface of the wall 216 external to the environment shown. The second alerting member is arranged to provide an equivalent alert to individuals exterior to the environment as an indicator that the individual has, or has not, made use of the hand cleansing device 202. The second alerting member is connected to the alerting member 220 through the wall 216 by a ribbon cable (not shown) passing through a hole 244 in the alerting member 220 and connecting to a connector 246 mounted on the PCB 226. The ribbon cable acts to provide the equivalent alert signals to corresponding LEDs of the second alerting member from the processor 236, and additionally to provide power to the second alerting member from the batteries 241 of the alerting member 220.

In the embodiment 200 shown, and supplementing each of the smiling face 232 and frowning face 230 is a corresponding verbal message reading "Thank You" 250 (corresponding to the positive alert 232) and "Please Wash Your Hands" 252 (corresponding to the negative alert 230), each of which are illuminated by the corresponding LEDs 227, 229 of the respective alert 230, 232.

The alerting member 220 of the embodiment shown is affixed to the wall 216 by way of a plurality of screws (not shown) fit through corresponding screw holes 254 in the base plate of the alerting member 220. The face plate of the alerting member is affixed to the base plate by way of a snap fit mechanism (not shown). Embodiments will be appreciated wherein any suitable affixing means and fit mechanism is used.

Figure 4:
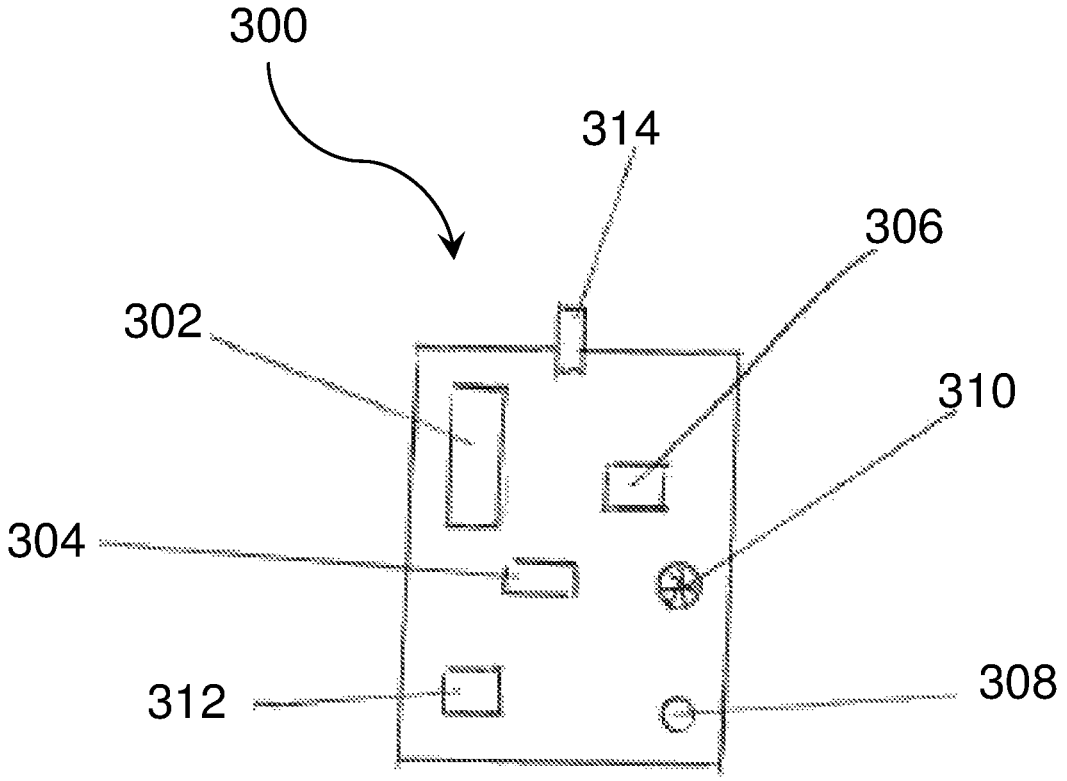
FIG. 4 shows a schematic view of an example circuitry for a hand cleansing device in accordance with the second aspect.

Referring to FIG. 4, shows a schematic view of an example circuitry 300 of a hand cleansing device such as that shown in FIG. 1 and FIG. 2, and in accordance with the second aspect. The circuitry 300 comprises a battery 302, a wireless communication module 304, which in the embodiment shown is a Bluetooth device 304, and a programmable microchip 306 which permits communication between elements of the hand cleansing dispenser. The microchip 306 may, for example permit the communication between a level sensor of the dispenser of the hand cleansing device and a corresponding level alerting member, as well as, for example monitoring a battery voltage and indicating whether the battery 302 requires re-charging or replacing. Also shown is an indicator light 308 (an LED in the example embodiment shown), arranged to indicate a timing completion of a predetermined time duration associated with safe and effective hand cleansing. An audible speaker 310 is also shown to indicate the timing completion. In order to play music and to receive and emit messages, a memory module 312 is also shown. To recharge the battery 302, a battery re-charging connector 314 is also shown.

Figure 5:
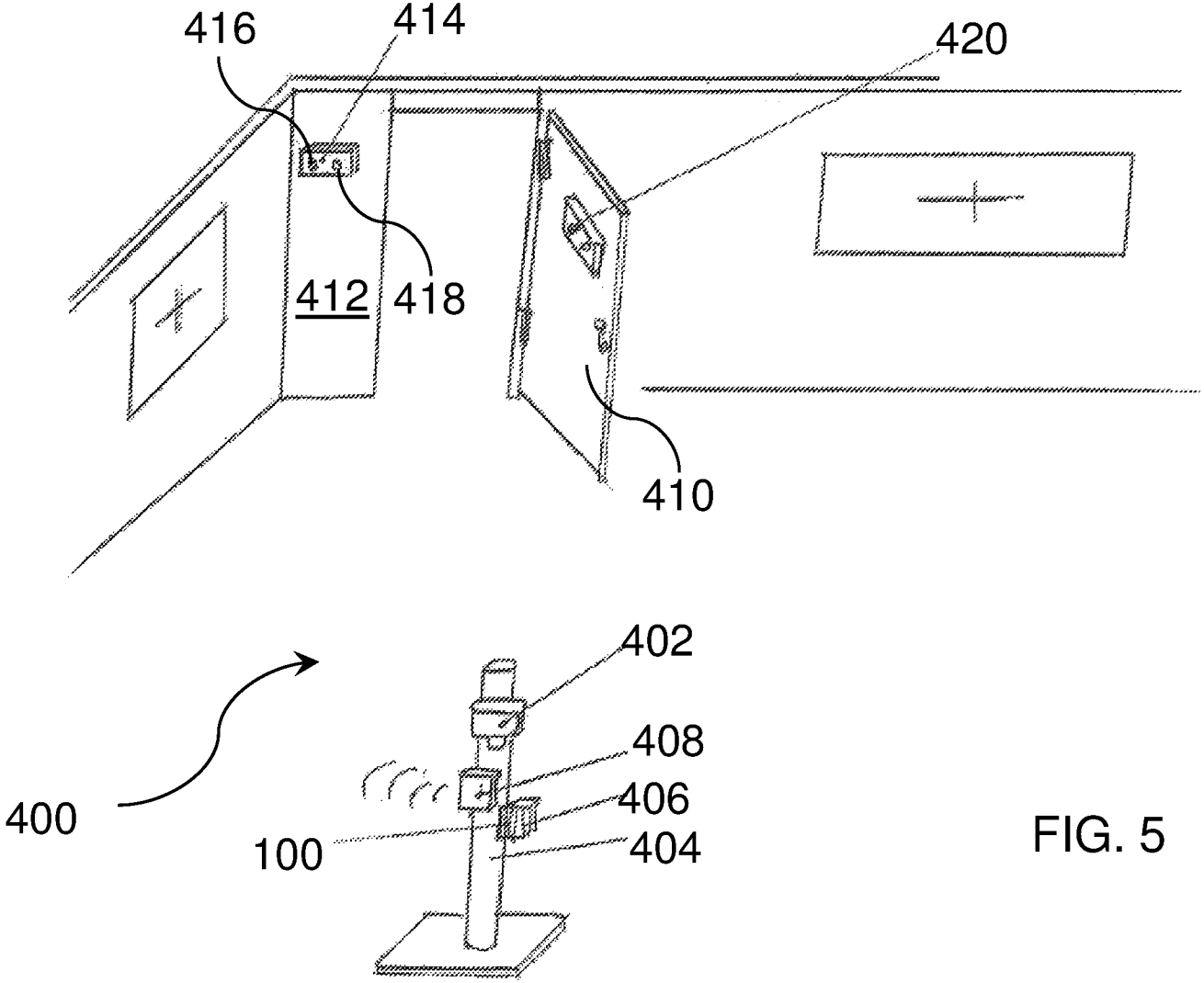
FIG. 5 shows an example embodiment of a hand cleansing device in accordance with the second aspect of the present invention, comprising a notification apparatus of the first aspect.

Referring to FIG. 5, a perspective view of an example embodiment 400 of a hand cleansing device is shown in accordance with the second aspect, comprising a notification apparatus in accordance with the first aspect. The device 400 comprises a hand cleansing device with dispenser 402 mounted on a floor stand 404, and a PCB enclosure 406 housing a PCB (not shown). The PCB enclosure 406 comprises a detector (passive infrared sensor in the embodiment shown) oriented to detect movement of an individual and provide an entrance signal to a processor and memory of the PCB. Also located on the stand 404 is an audible and visual notification device 408 which is in digital communication with the PCB. Also shown is a door 410 providing an exit to the room, and placed on an interior wall 412 of the room proximate the door is an alerting member 414 comprising a housing accommodating red and green lights 416, 418 each of which indicate if the hand cleansing dispenser has been used or not used as described previously. FIG. 5 also shows a similar alerting member 420 positioned on an exterior surface of the door 410 for external alerting as discussed herein. FIG. 5 acts to combine the features of the embodiments described in FIGS. 1 to 4.

Embodiments will be appreciated wherein any suitable combination of the above embodiments, such as a combination of a notification apparatus of FIG. 1 and the notification apparatus of FIG. 2 may be combined into a single hand cleansing device or system.

It will be appreciated that the above described embodiments are given by way of example only and that various modifications may be made to the described embodiments without departing from the scope of the invention as defined in the appended claims. For example, the notification members described are arranged to provide a visible and/or audible notification. Embodiments will be appreciated wherein any suitable notification may be provided, such a haptic notification. The embodiment described in relation to FIG. 1 is described as having a timer setting a predetermined notification period. Embodiments will be appreciated in accordance with FIG. 1 without the timer, and wherein receipt of the actuation signal by the processor causes a direct output of an audible and/or visible and/or haptic notification by the notification member, which may itself have a predetermined duration.

The invention claimed is:

1. A notification apparatus for providing a notification during or following actuation of a hand cleansing device, the apparatus comprising:

a hand cleansing device actuation sensor arranged to detect an actuation of a hand cleansing device by an individual, and further arranged to output an actuation signal following said actuation;

a controller arranged to receive the actuation signal and output a control signal according to the actuation signal;

a notification member arranged to receive the control signal and output a notification to the individual based on the control signal; and a detector array comprising one or more detectors, the detector array arranged to detect an exit action of the individual, and output an exit signal following said detection;

wherein the controller is further arranged to:

receive the exit signal;

identify the exit signal and an absence of the actuation signal; and output an alert signal following said identification;

the notification member being arranged to receive the alert signal and output an alert to the individual.

2. A notification apparatus as claimed in claim 1, wherein the notification comprises a duration, the duration being a predetermined notification period.

3. A notification apparatus as claimed in claim 1 or claim 2, wherein the apparatus further comprises a timer in communication with the controller and arranged to provide the predetermined notification period, the controller arranged to output the control signal according to the predetermined notification period.

4. A notification apparatus as claimed in claim 2 or claim 3, wherein the notification member is arranged to output the notification during at least a portion of the predetermined notification period and/or immediately following the predetermined notification period, based on the control signal.

5. A notification apparatus as claimed in any one of claims 1 to 4, wherein the predetermined notification period is predetermined according to a safe minimum hand cleansing period.

6. A notification apparatus as claimed in claim 5, wherein the safe minimum hand cleansing period is selected from between 10 seconds and 30 seconds.

7. A notification apparatus as claimed in any one of claims 1 to 6, wherein the notification comprises one selected from the group: a countdown timer; an audio sequence; a video sequence; a light sequence; a haptic sequence; a vibratory sequence; a movement sequence.

8. A notification apparatus as claimed in claim 1, wherein the detector array comprises one or more sensors arranged to detect the exit action, the one or more sensors being selected from the group: an infrared sensor; door lock actuation sensor; a door actuation sensor; a door handle actuation sensor; a pressure sensor; a proximity sensor; a motion sensor; an automatic door actuation sensor; a trembler device.

9. A notification apparatus as claimed in claim 8, wherein the controller is arranged to determine a time period between the actuation signal and the exit signal; wherein the controller is further arranged to detect that the time period is shorter than a predetermined time threshold, and output the alert signal following said detection.

10. A notification apparatus as claimed in claim 8 or claim 9, wherein the alert is a visible and/or audible alert and/or haptic alert.

11. A notification apparatus as claimed in any one of claims 8 to 10, wherein the detector array is in wireless communication with the hand cleansing device actuation sensor.

12. A notification apparatus as claimed in any one of claims 8 to 11, wherein the notification member comprises an alerting array having a first alerting member positioned on or proximate an interior surface of a room, and a second alerting member positioned on or proximate an exterior surface of said room.

13. A notification apparatus as claimed in any one of the preceding claims, wherein the notification member comprises an on-board power supply, and is preferably battery-powered.

14. A notification apparatus as claimed in any one of the preceding claims, wherein the notification member is positioned on or proximate an entrance and/or exit to a space, and is preferably positioned on or proximate an entrance and/or exit door.

* * * * *